US007162776B2

(12) United States Patent
Schmitz

(10) Patent No.: US 7,162,776 B2
(45) Date of Patent: Jan. 16, 2007

(54) APPARATUS IN A SPINNING PREPARATION MACHINE FOR MEASURING DISTANCES AT THE FLAT BAR CLOTHING

(75) Inventor: Thomas Schmitz, Mönchengladbach (DE)

(73) Assignee: Trützschler GmbH & Co. KG, Monchengladbach (DE)

( * ) Notice: Subject to any disclaimer, the term of this patent is extended or adjusted under 35 U.S.C. 154(b) by 446 days.

(21) Appl. No.: 10/695,772

(22) Filed: Oct. 30, 2003

(65) Prior Publication Data

US 2004/0099581 A1 May 27, 2004

(30) Foreign Application Priority Data

Nov. 6, 2002 (DE) ..... 102 51 574

(51) Int. Cl.
*D01G 15/02* (2006.01)

(52) U.S. Cl. ..... 19/102; 19/104

(58) Field of Classification Search ..... 19/98, 19/102–105, 110–114
See application file for complete search history.

(56) References Cited

U.S. PATENT DOCUMENTS

| | | | | |
|---|---|---|---|---|
| 5,040,272 | A | 8/1991 | Fritzsche | |
| 5,398,381 | A * | 3/1995 | Schlichter et al. | 19/102 |
| 5,930,869 | A | 8/1999 | Faas et al. | |
| 6,247,336 | B1 * | 6/2001 | Steinert | 66/102 |
| 6,317,931 | B1 * | 11/2001 | Steinert | 19/104 |

FOREIGN PATENT DOCUMENTS

| | | | |
|---|---|---|---|
| DE | 39 13 996 | A1 | 8/1990 |
| DE | 42 35 610 | A1 | 4/1994 |
| DE | 44 31 922 | A1 | 5/1996 |
| DE | 196 51 894 | A1 | 6/1998 |
| DE | 199 23 419 | A1 | 11/2000 |
| DE | 199 23 420 | A1 | 11/2000 |
| EP | 0 567 747 | B1 | 11/1993 |
| EP | 0 627 508 | A1 | 12/1994 |
| EP | 0 801 158 | A1 | 10/1997 |
| GB | 2 272 458 | | 5/1994 |
| GB | 2 320 260 | | 6/1998 |
| GB | 2 350 124 | | 11/2000 |
| GB | 2 350 126 | | 11/2000 |

OTHER PUBLICATIONS

Tränkler, H.-R., Obermeier, E.: Sensortechnik. Handbuch für Praxis und Wissenschaft.Springer-Verlag, 1998; S.521, 10.2.3, S.571, 10.3.3.

* cited by examiner

*Primary Examiner*—Gary L. Welch
(74) *Attorney, Agent, or Firm*—Venable LLP; Robert Kinberg; Steven J. Schwarz

(57) ABSTRACT

An arrangement in a spinning preparation machine is provided. The arrangement has a clothed roll having clothing presenting free ends; flat bar slide elements; clothed flat bars having clothing presenting free ends and cooperating with the clothing of the clothed roll, the flat bars having slide guides which glide on the flat bar slide elements; and a measuring apparatus comprising at least one sensor arranged for detecting a distance between a reference surface and at least one of the free ends of the clothing of the clothed roll and the free ends of the clothing of the clothed flat bars.

20 Claims, 4 Drawing Sheets

APPARATUS IN A SPINNING PREPARATION MACHINE FOR MEASURING DISTANCES AT THE FLAT BAR CLOTHING

CROSS-REFERENCE TO RELATED APPLICATION

This application claims priority to German Patent Application No. 102 51 574.3, filed Nov. 6, 2002, the disclosure of which is incorporated herein by reference.

BACKGROUND OF THE INVENTION

The invention relates to an apparatus provided in a spinning preparation machine, such as a carding machine, a cleaner, or the like, for measuring distances between a sensor and clothing surfaces, where a clothed roll (main carding cylinder) cooperates with clothed flat bars which glide on slide guides by means of flat bar slide elements.

The distances between the clothing of the main carding cylinder and clothings which face same are of substantial significance as concerns machine and fiber technology. The carding result, that is, the cleaning, nep formation and fiber shortening, is to a large measure dependent from the carding clearance, that is, from the distance between the clothing of the main carding cylinder and the clothings of the traveling flats. The guidance of air about the main carding cylinder and the removal of heat are also dependent from the distance between the clothing of the main carding cylinder and the clothed flat bars. The distances are affected by various, partly opposed influences. The wear of facing clothing leads to an increase of the carding clearance which involves an increase of the nep number and a decrease of the fiber shortening. An increase of the rpm of the main carding cylinder, for example, for intensifying the cleaning effect, causes, by virtue of centrifugal forces, an expansion of the main carding cylinder, including its clothing, and thus results in a decrease of the carding clearance. A temperature increase when processing large fiber quantities and certain fiber types, such as chemical fibers, also causes the main carding cylinder to expand, so that for this reason too, the distances decrease. The carding clearance is affected particularly by the machine settings, on the one hand, and by the condition of the clothing, on the other hand. The most important carding clearance of the traveling flats type carding machine is located in the principal carding zone, that is, between the main carding cylinder and the traveling flats assembly. In most cases both clothings which border the working distance are in motion.

In practice, the quality of the flat bar clothing is regularly optically examined by an attendant. A wear results in an increase of the carding clearance. In a known apparatus described in German Patent Document DE-OS 199 23 419, the distance between a sensor and the points of the flat bar clothing is determined. The stationary sensor is associated with the traveling flats and is facing the flat bars as they are guided along their return path.

SUMMARY OF THE INVENTION

It is an object of the invention to improve an apparatus of the type described above for measuring the distances at the clothing of the carding machine.

Embodiments of the invention include an arrangement in a spinning preparation machine. The arrangement has a clothed roll having clothing presenting free ends; flat bar slide elements; clothed flat bars having clothing presenting free ends and cooperating with the clothing of the clothed roll, the flat bars having slide guides which glide on the flat bar slide elements; and a measuring apparatus comprising at least one sensor arranged for detecting a distance between a reference surface and at least one of the free ends of the clothing of the clothed roll and the free ends of the clothing of the clothed flat bars.

The measures according to the invention permit a simple and direct determination of the distance between the clothing points and the slide surface of the flat bar slide elements (for example, flat bar pins). In this manner, on the one hand, a quality monitoring concerning the uniformity of the flat bars may be obtained and, on the other hand, a simpler and more accurate setting of the distance between the points of the flat bar clothing and the main carding cylinder may be effected. It is a particular advantage to determine the wear, that is, the consumption of the flat bar clothing, particularly after a long running period. Upon a change in the carding clearance, the effect of the change of the flat bar clothing is determined directly as concerns wear and also indirectly as concerns the distance change relative to the main carding cylinder, particularly due to the wear of the clothing of the main carding cylinder, the expansion of the main carding cylinder effected by centrifugal forces and temperature change. In this manner an optimal setting of the carding clearance is feasible, namely, related to a desired value. Measuring is possible during operation.

It is a further advantage that the geometrically tallest flat bar is found. Furthermore, an adjustment of the flat bar after the grinding of the flat bar clothing is possible.

Expediently, the height/distance sensor determines the distance "c" between the free ends of the flat bar clothing and the slide surfaces of the flat bar slide elements. In practice slight manufacturing tolerances of the flat bars and the clothing may appear which may be ascertained in this manner. This makes possible a determination of a mid value for the distance "c" for a plurality or for all of the flat bars, thus obtaining a uniform carding clearance. Furthermore, determining the distance "c" yields a magnitude with which the carding clearance "a" may be directly calculated. Advantageously, the height/distance sensor may determine the distance "b" between the free ends of the clothing of the main carding cylinder and the slide guide for the flat bar slide elements. As a result, a further magnitude is made available in a simple manner for directly calculating the carding clearance "a".

Due to the fact that the slide faces of the flat bar slide elements glide on the slide guide, the slide faces correspond to the slide guide. The distance "a" (carding clearance) between the free ends of the flat bar clothing and the free end of the clothing of the main carding cylinder is preferably determined in accordance with the relationship "a"="b"–"c". The determination is effected expediently by computation, for which preferably an electronic regulating and control device may be used. In this manner, at the same time, a predetermined optimal carding clearance may be automatically set by a device which is connected to the electronic control and regulating device. The computed carding clearance may, however, also be outputted to an indicating device, a monitor, a printer or the like. Thus the carding clearance may be set by a control with an inputting device or may be set manually in a mechanical manner.

The invention permits a determination of the important distance between the slide surface of the flat bar heads and the free ends (points) of the flat bar clothing. Further, by the measures according to the invention, an accurate adjustment of the flat bar heads with respect to the clothing points is effected and thus the correct distance between the clothing points and the clothing of the main carding cylinder (carding clearance) is obtained.

BRIEF DESCRIPTION OF THE DRAWINGS

The invention is explained below in further detail with the aid of exemplary embodiments shown in the drawings, wherein.

DETAILED DESCRIPTION OF PREFERRED EMBODIMENTS

Figure 1:
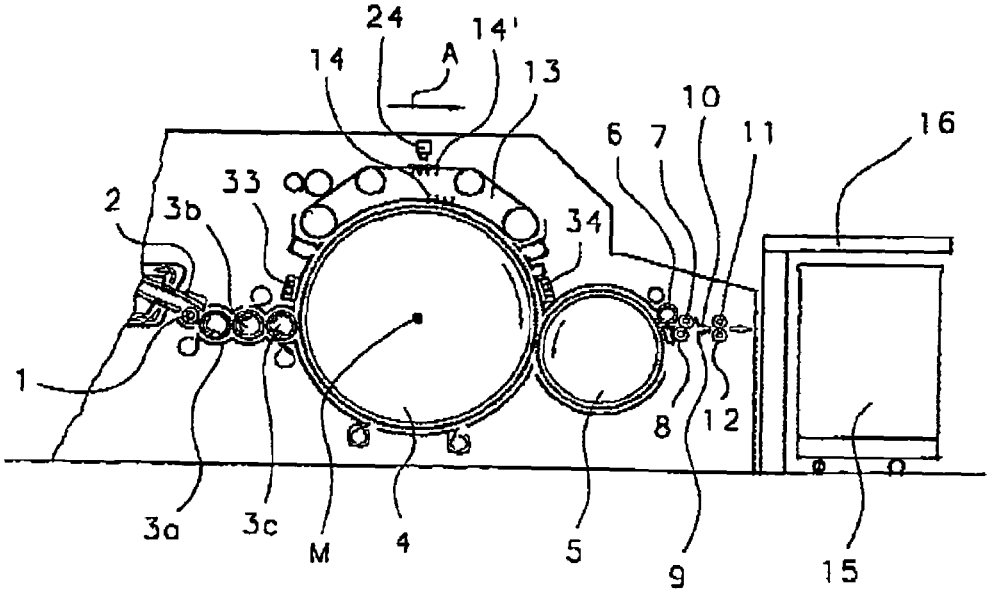
FIG. 1 shows a schematic side view of a carding machine including an apparatus according to the invention.
Figure 2A:
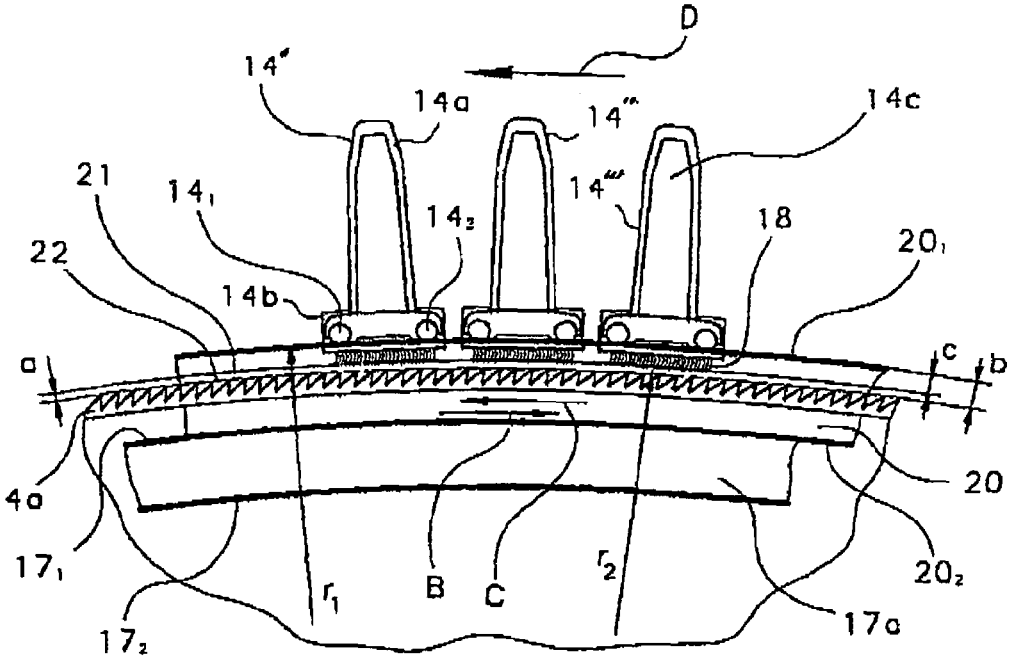
FIGS. 2*a* and 2*b* show a side view and section through clothed flat bars, a part of a slide guide and a flexible bend and the distance between the clothing of the flat bars and the clothing of the main carding cylinder.
Figure 2B:
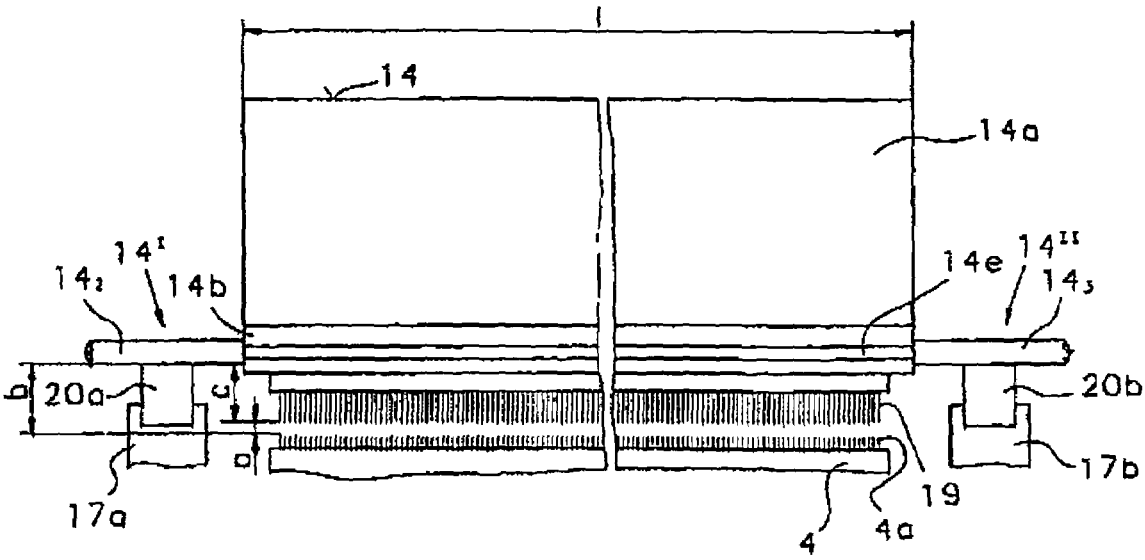

FIGS. 1, 2*a* and 2*b* show a carding machine, for example, a Trützschler high-performance carding machine DK 903, including a feed roll 1, a feed table 2, licker-ins 3*a*, 3*b*, 3*c*, a main carding cylinder 4, a doffer 5, a stripping roll 6, crushing rolls 7, 8, a web guiding element 9, a sliver trumpet 10, calendar rolls 11, 12, traveling flats 13 having clothed flat bars 14, a coiler can 15 and a sliver coiler 16. The rotary directions of the rolls are indicated by curved arrows. The working direction is designated at arrow A. Stationary carding elements 33 and 34 face the main carding cylinder clothing 4*a*. The apparatus 24 according to the invention is arranged facing the clothing of the returning flat bars 14'.

According to FIG. 2*a*, a flexible bend 17*a*, having a plurality of non-illustrated set screws, is secured to the machine stand, laterally on each side of the carding machine. The flexible bend 17*a* has a convex outer surface $\mathbf{17}_1$ and an underside $\mathbf{17}_2$. A slide guide 20, made, for example, of a low-friction plastic material is arranged above the flexible bend 17*a*. The slide guide 20 has a convex outer surface $\mathbf{20}_1$ and a concave inner surface $\mathbf{20}_2$. The concave inner surface $\mathbf{20}_2$ lies on the convex outer surface $\mathbf{17}_1$ and may glide thereon in the direction of arrows B, C. A slide guide 20 and a convex outer surface 17 are provided to support each end of the flat bars (shown as 20*a*, 20*b*, 17*a* and 17*b* in FIG. 2*b*). Each flat bar 14 which may be structured, for example, in accordance with European Patent Application EP 0 567 747 A1, is formed of a back part 14*a* and a carrier body 14*b*. The carrier body 14*b* has a foot surface, two side surfaces and two upper surfaces. Each flat bar 14 has, at both ends, a respective flat bar head $\mathbf{14}^I$, $\mathbf{14}^{II}$ (see FIG. 2*b*) each having two steel pins $\mathbf{14}_1$, $\mathbf{14}_2$ and, respectively, $\mathbf{14}_3$, $\mathbf{14}_4$ which are, with one part, axially affixed to the flat bar. The parts of the steel pins $\mathbf{14}_1$, $\mathbf{14}_2$ projecting beyond the end faces of the carrier body 14*b* glide on the convex outer surface $\mathbf{20}_1$ of the slide guide 20 in the direction of the arrow D.

A clothing strip 18, having clothing 19, is mounted on the underface of the carrier body 14*b*. The circle circumscribing the points of the flat bar clothing 19 is designated as 21. The main carding cylinder 4 has on its periphery a main carding cylinder clothing 4*a*, such as a saw tooth clothing. The circle circumscribing the points of the main carding cylinder clothing 4*a* is designated as 22. The distance between the circles 21 and 22 is designated by "a" and is, for example, 3/1000". The distance between the convex outer surface $\mathbf{20}_1$ and the circle 22 is designated by "b". The radius of the convex outer surface $\mathbf{20}_1$ is designated as $r_1$, and the radius of the circle 22 is designated as $r_2$. The radii $r_1$ and $r_2$ are taken from the axis M of the main carding cylinder 4.

Figure 3:
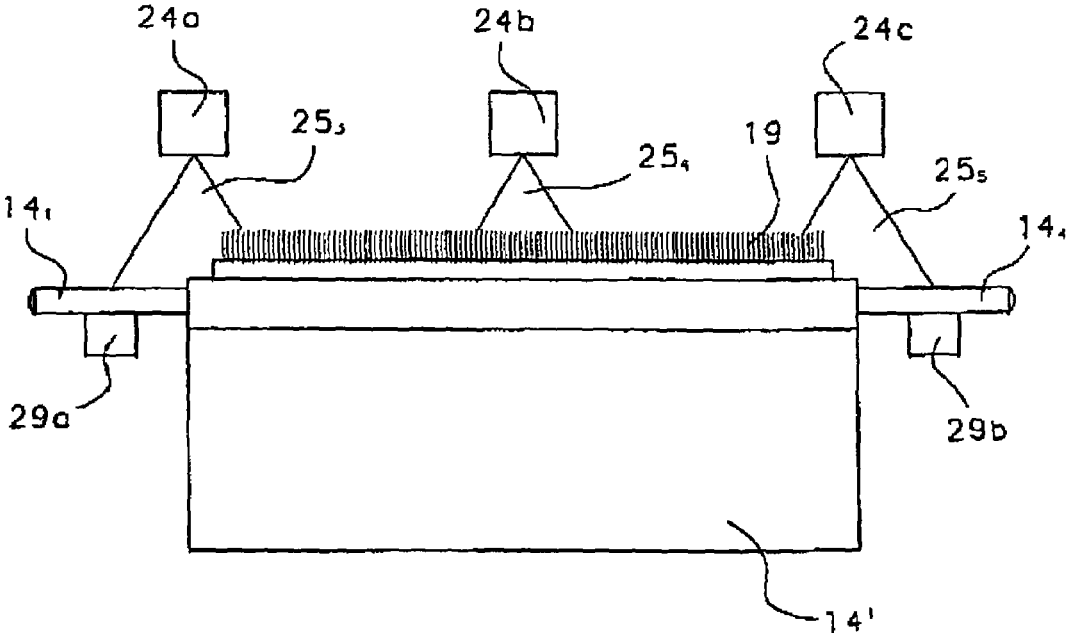
FIG. 3 shows a front view of a returning flat bar and three apparatuses according to the invention.

FIG. 3 shows a flat bar 14' whose steel pins $\mathbf{14}_1$, $\mathbf{14}_2$ and $\mathbf{14}_3$, $\mathbf{14}_4$ glide on stationary supports 29*a* and 29*b*, respectively, during the return travel on that side of the traveling flats 13 (see FIG. 1) which is opposite the slide guide 20. Three light section sensors 24*a*, 24*b* and 24*c*, for example, SICK light section sensors DMH, functioning as height/distance sensors face at a distance the clothing 19 of the flat bar 14'. Light sensors 24*a*, 24*b*, and 24*c* produce light beams $\mathbf{25}_3$, $\mathbf{25}_4$ and $\mathbf{25}_5$, respectively. The light section sensors are sensors having a large measuring range. The provision of the three sensors 24*a* through 24*c* allows conclusions to be drawn concerning the wear of the flat bar 14 as viewed over the length l (see FIG. 2*b*).

Figure 4:
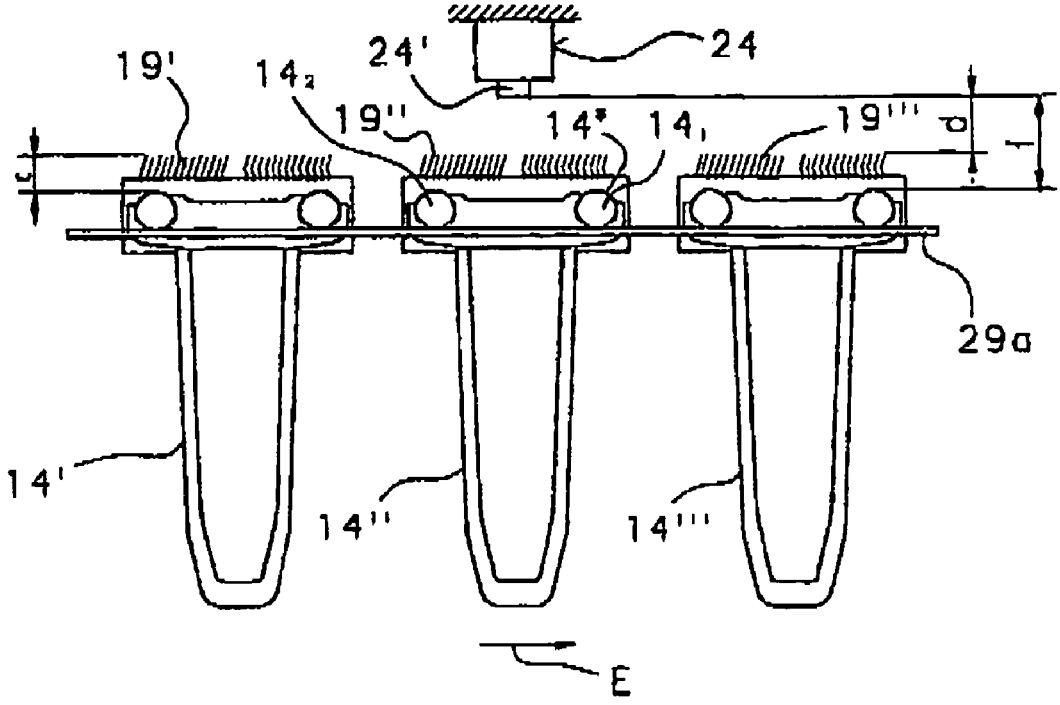
FIG. 4 shows a side view of three returning flat bars and a stationary measuring apparatus.
Figure 5:
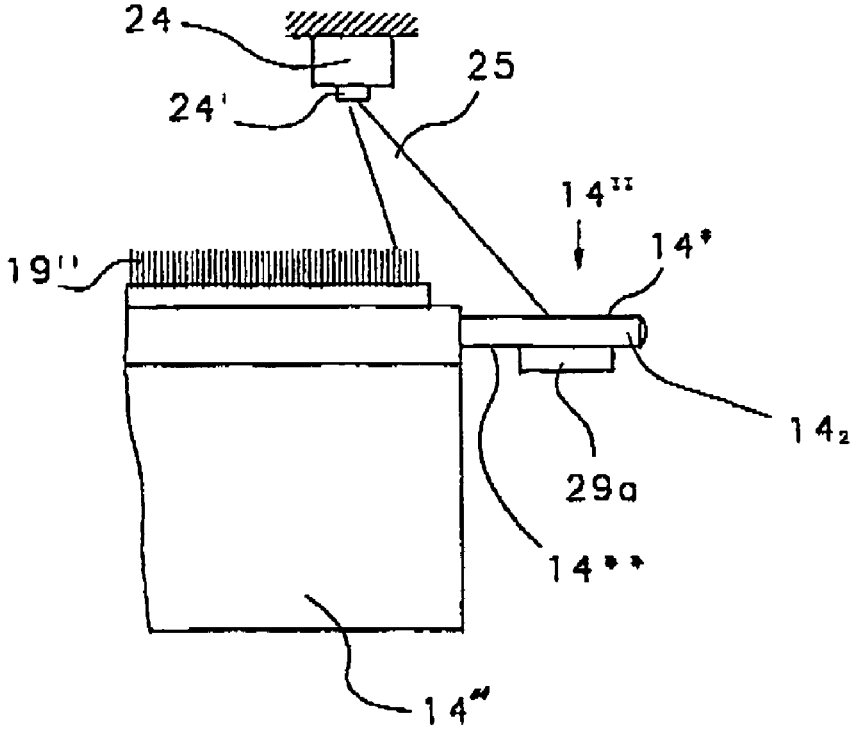
FIG. 5 shows a laser beam of a light section sensor in the zone of a flat bar head.

According to FIGS. 4 and 5, three flat bars 14', 14", 14''' have clothing 19', 19", 19''', respectively.

Flat bar 14" glides with surfaces 14 of the slide pins $\mathbf{14}_1$ through $\mathbf{14}_4$ in the direction E over the stationary support 29***a*. The measuring surface 24' of the stationary sensor 24 faces at a distance d the points of the clothing 19" of the flat bar 14". The light section sensor 24 generates, in the direction of the flat bar length (see FIG. 5), a laser beam 25 which impinges on the slide surfaces 14* of the slide pins $\mathbf{14}_1$ through $\mathbf{14}_4$ as well as on the flat bar clothing 19". As the flat bars 14 pass under the sensor 24, the height profile shown in FIG. 5 is obtained. For an evaluation, the measured value of the two slide pins $\mathbf{14}_3$, $\mathbf{14}_4$ is deducted from the maximum value which is to be filtered out via the constant pin distance. The height difference c thus obtained is utilized for checking the flat bars 14 (uniformity check) and/or for setting the carding clearance "a". The distance between the free ends of the flat bar clothing 19" and the slide surfaces 14* of the flat bars $\mathbf{14}_1$ through $\mathbf{14}_4$ is designated as "c". The distance between the sensor 24' and the slide surfaces 14* of the flat bars $\mathbf{14}_1$ through $\mathbf{14}_4$ is designated as "f". The distance between the sensor 24' and the free ends of the flat bar clothing 19" is designated as "d".

Figure 6:
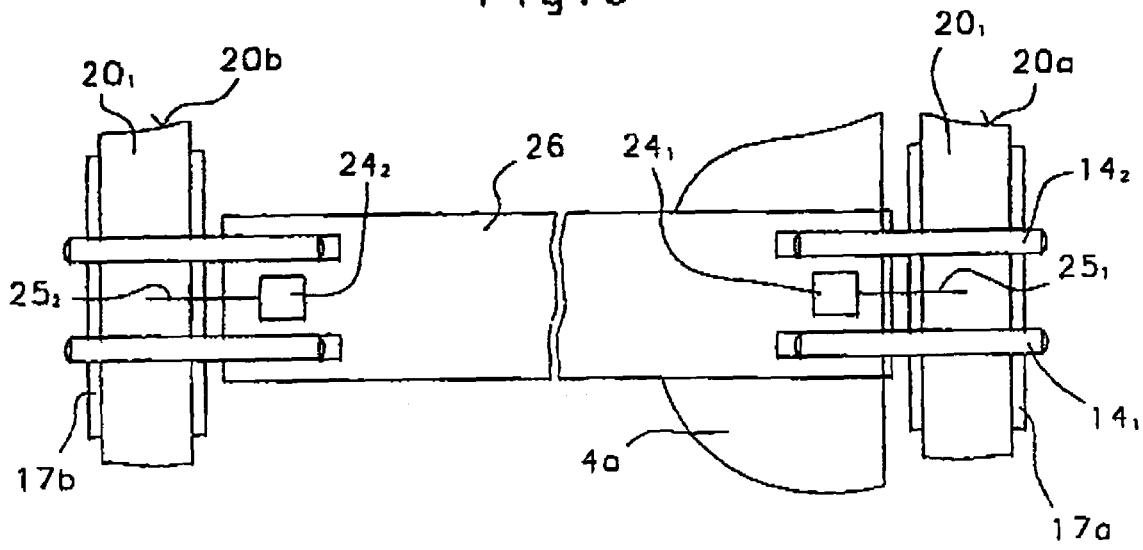
FIG. 6 shows a top view of a measuring flat bar having two light section sensors.

As shown in FIG. 6, the flat bar heads of a measuring flat bar 26 glide on the outer surfaces $\mathbf{20}_1$ of the slide guides 20*a* and 20*b*, respectively (see FIGS. 2*a*, 2*b*). In the regions of the two ends of the measuring flat bar 26, respective light section sensors $\mathbf{24}_1$ and $\mathbf{24}_2$ as height/distance sensors are arranged between the two pins of the respective flat bar heads. The light section sensors $\mathbf{24}_1$ and $\mathbf{24}_2$ generate, in the length direction of the flat bars (axial direction), laser beams $\mathbf{25}_1$ and $\mathbf{25}_2$ which impinge on the outer surfaces $\mathbf{20}_1$ and $\mathbf{20}_2$ as well as on the surface of the clothing 4*a* of the main carding cylinder 4. As the measuring flat bar 26 passes over the outer surfaces $\mathbf{20}_1$, $\mathbf{20}_1$ and the main carding cylinder clothing 4*a*, a height profile is obtained which is evaluated and which yields a height difference "b" (see FIGS. 2*a*, 2*b*).

Figure 7:
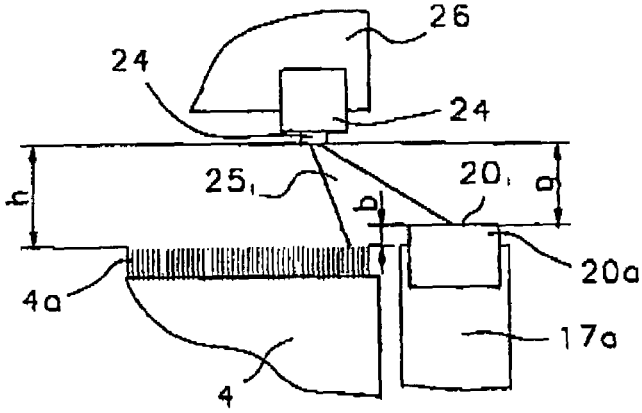
FIG. 7 shows a laser beam of a light section sensor in the zone of a flat bar head of a measuring flat bar.

According to FIG. 7 the distance between the sensor $\mathbf{24}_1$ and the slide surface $\mathbf{20}_1$ (outer surface) of the slide guide 20 is designated as "g". The distance between the sensor $24_1$ and the points of the main carding cylinder clothing 4*a* is designated as "h". The height difference between "h" and "g" results in "b". It is noted in this connection that the slide surfaces 14* of the slide pins $14_1$ through $14_4$ lie on the outer surfaces $20_1$, $20_1$ and glide thereon.

As a result, the distance "a" (carding clearance) is obtained between the free ends of the fat bar clothing 19 and the free ends of the main carding cylinder clothing 4*a* by the relationship "a"="b"−"c".

In practice at least one of the flat bars 14', 14", 14'" is replaced by the measuring flat bar 26 for the duration of the measuring process. Thus, the measuring flat bar 26 circulates endlessly—like the flat bars 14—by means of two (non-illustrated) toothed belts on either side of the carding machine.

The measuring flat bar 26 may also be advantageously installed stationarily relative to the clothing 19 of the returning flat bars 14 as shown in FIG. 4.

Figure 8:
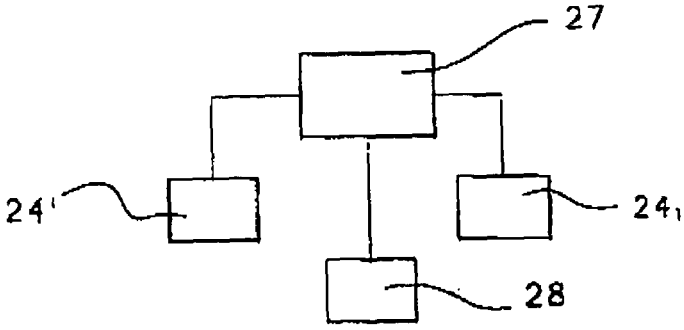
FIG. 8 shows a block diagram of an electronic regulating and control device to which at least a stationary sensor, a moved sensor and a setting device for displacing the slide guides are connected.

According to FIG. 8 an electronic control and regulating device 27, for example a microcomputer, is provided to which, for example, the stationary sensor 24' and the circulating sensor $24_1$ are connected. The carding clearance "a" is calculated from the measuring results yielded by the sensors 24' and $24_1$. The computed carding clearance "a" is compared with a stored (pre-given) carding clearance a'. Further, to the electronic control and regulating device 27 an automatic setting device 28 for the carding clearance "a" is connected which is known, for example, from German Patent Document DE-OS 196 51 894.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention.

The embodiments illustrated and discussed in this specification are intended only to teach those skilled in the art the best way known to the inventors to make and use the invention. Nothing in this specification should be considered as limiting the scope of the invention. All examples presented are representative and non-limiting. The above-described embodiments of the invention may be modified or varied, without departing from the invention, as appreciated by those skilled in the art in light of the above teachings. It is therefore to be understood that the invention may be practiced otherwise than as specifically described.

What is claimed is:

1. An arrangement in a spinning preparation machine, comprising:

a clothed roll having clothing presenting free ends;

flat bar slide elements;

clothed flat bars having clothing presenting free ends and cooperating with the clothing of the clothed roll, the flat bars having slide guides which glide on the flat bar slide elements; and a measuring apparatus comprising at least one sensor arranged for detecting a distance between a reference surface on at least one of the slide guides and the flat bar slide elements, and at least one of the free ends of the clothing of the clothed roll and the free ends of the clothing of the clothed flat bars.

2. The arrangement according to claim 1, wherein the reference surface is a slide surface of the flat bar slide elements, and the sensor determines a distance between the free ends of the flat bar clothing and the reference surface.

3. The arrangement according to claim 1, wherein the reference surface is a surface of the slide guides for the flat bar slide elements, and the sensor determines a first distance between the free ends of the clothed roll clothing and the reference surface.

4. The arrangement according to claim 3, wherein the sensor determines a second distance between the free ends of the flat bar clothing and the reference surface.

5. The arrangement according to claim 4, wherein a carding clearance between the free ends of the flat bar clothing and the free ends of the clothed roll clothing is determined by subtracting the second distance from the first distance.

6. The arrangement according to claim 4, wherein a distance between the flat bar clothing and the clothed roll clothing is set using the determined distances.

7. The arrangement according to claim 1, wherein the sensor is a light section sensor.

8. The arrangement according to claim 1, wherein the sensor is a displacement sensor.

9. The arrangement according to claim 1, wherein the sensor detects distance differences.

10. The arrangement according to claim 1, wherein the sensor detects absolute distances.

11. The arrangement according to claim 1, wherein the flat bars are part of traveling flats of the machine.

12. The arrangement according to claim 1, wherein the sensor is adapted to detect wear of the flat bar clothing based on the distance between the reference surface and at least one of the free ends of the clothing of the clothed roll and the free ends of the clothing of the clothed flat bars.

13. The arrangement according to claim 1, wherein the sensor senses a distance between a measuring surface of the sensor and slide surfaces of the flat bar slide elements.

14. The arrangement according to claim 1, wherein the sensor senses a distance between a measuring surface of the sensor and a slide surfaces of the slide guides.

15. The arrangement according to claim 1, wherein the sensor senses a distance between a measuring surface of the sensor and the free ends of the clothed roll clothing.

16. The arrangement according to claim 1, wherein the measuring apparatus detects said distance in a region where the flat bar slide elements engage the slide surfaces of the slide guides.

17. The arrangement according to claim 1, wherein the sensor is connected to an electronic control and regulating device.

18. The arrangement according to claim 17, wherein a device for setting a distance between the flat bar clothing and the clothed roll clothing is connected to the electronic control and regulating device.

19. The arrangement according to claim 18, wherein the electronic control and regulating device has a memory for storing desired values of the distance between the flat bar clothing and the clothed roll clothing.

20. The arrangement according to claim 19, wherein one of a switching process and an indication is triggered when the distance between the flat bar clothing and the clothed roll clothing exceeds one of the desired values stored in the memory.

* * * * *